US005154875A

United States Patent [19]

Luchs

[11] Patent Number: 5,154,875

[45] Date of Patent: Oct. 13, 1992

[54] SLIDE GATE NOZZLE OR SHUT-OFF CONTROL VALVE FOR METALLURGICAL VESSEL AND REFRACTORY SHUT-OFF PARTS THEREOF

[75] Inventor: Willi Luchs, Root, Switzerland

[73] Assignee: Stopinc Aktiengesellschaft, Baar, Switzerland

[21] Appl. No.: 613,522

[22] PCT Filed: Feb. 7, 1990

[86] PCT No.: PCT/EP90/00198

§ 371 Date: Nov. 8, 1990

§ 102(e) Date: Nov. 8, 1990

[87] PCT Pub. No.: WO90/11854

PCT Pub. Date: Oct. 18, 1990

[30] Foreign Application Priority Data

Mar. 31, 1989 [CH] Switzerland ..... 1189/89

[51] Int. Cl.[5] ..... B22D 41/24

[52] U.S. Cl. ..... 266/236; 222/597; 222/598

[58] Field of Search ..... 222/591, 594, 597, 598, 222/599, 602, 600, 601; 266/236

[56] References Cited

U.S. PATENT DOCUMENTS

| | | | |
|---|---|---|---|
| 2,575,464 | 11/1951 | Olsen | 222/600 |
| 4,632,283 | 12/1986 | Arakawa et al. | 222/600 |
| 4,747,580 | 5/1988 | Tinnes et al. | 222/600 |
| 4,759,479 | 7/1988 | Tinnes | 222/600 |
| 4,949,886 | 8/1990 | Lührsen et al. | 222/598 |

FOREIGN PATENT DOCUMENTS

| | | | |
|---|---|---|---|
| 0303475 | 2/1989 | European Pat. Off. . | |
| 0308597 | 3/1989 | European Pat. Off. . | |
| 0332868 | 9/1989 | European Pat. Off. . | |
| 8800059 | 4/1988 | Fed. Rep. of Germany . | |
| 0030339 | 7/1977 | Japan | 222/600 |

*Primary Examiner*—Scott Kastler

*Attorney, Agent, or Firm*—Wenderoth, Lind & Ponack

[57] ABSTRACT

A slide gate nozzle or shut-off control valve to be mounted in a wall or lining of a vessel containing molten metal includes shut-off parts each of which are provided with passages or openings. The parts project into the vessel interior and each part has at least one approximately planar sliding surface, with such surfaces abutting and being displaceable relative to one another in order to open or close the passages or openings.

51 Claims, 3 Drawing Sheets

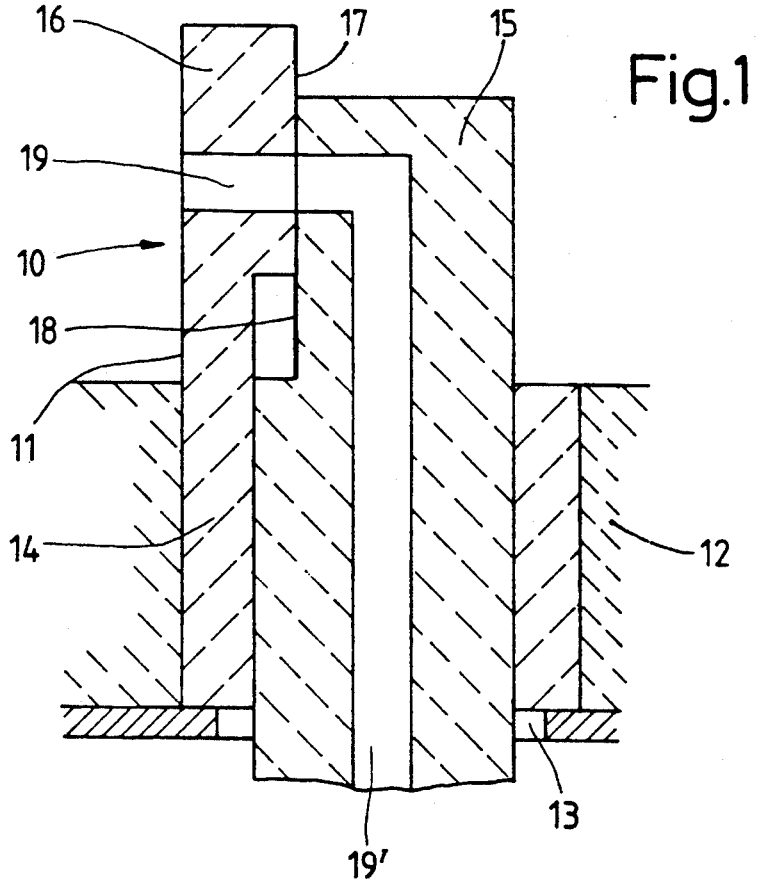
Fig.1
Fig.2
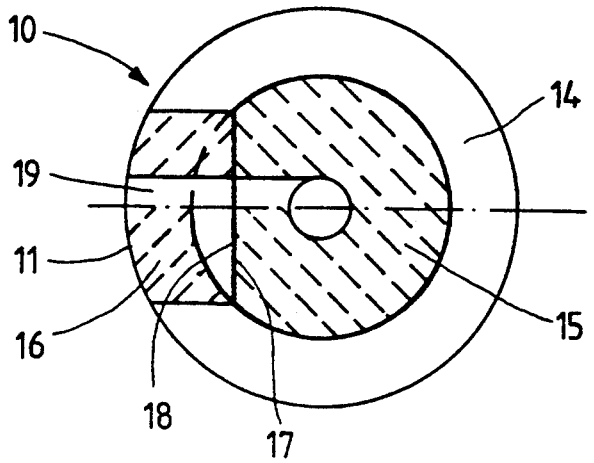

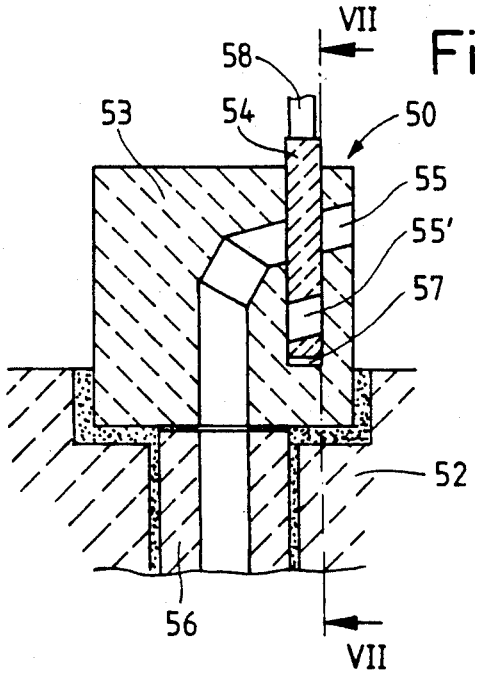
Fig.6
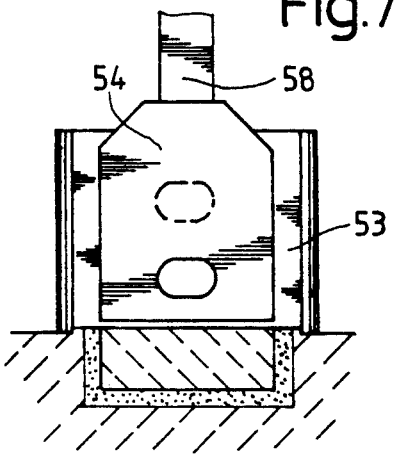
Fig.7
Fig.8
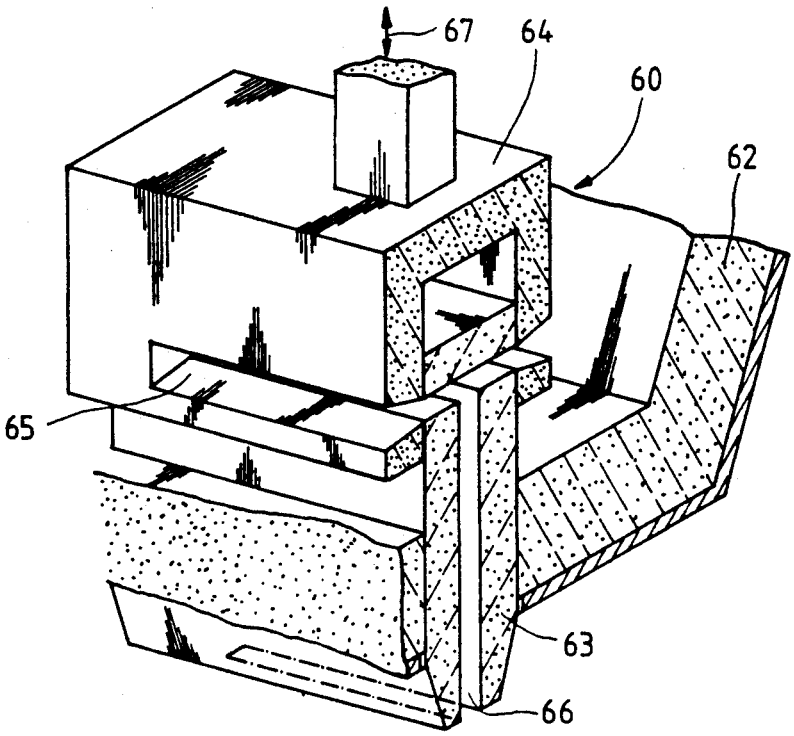

SLIDE GATE NOZZLE OR SHUT-OFF CONTROL VALVE FOR METALLURGICAL VESSEL AND REFRACTORY SHUT-OFF PARTS THEREOF

BACKGROUND OF THE INVENTION

The invention relates to a slide gate nozzle or shut-off control valve to be mounted in a wall or lining of a vessel containing, in particular, molten metal and including at least two refractory shut-off parts that are provided with passages or openings, that project into the vessel interior and that have respective sliding surfaces that can be displaced sealingly relative to one another. The invention also relates to refractory shut-off parts for such nozzle or valve.

A final control supply element of the above described category is disclosed in German DE-P 35 40 202 and substantially comprises two concentric tubes or pipes that project into the vessel, that can be moved therein relative to one another and that have openings through which the melt passes. The openings of the pipes can be brought more or less into alignment or coincidence by means of axial lifting movement and/or rotary movement. Thus, it is possible to correspondingly regulate the volume of molten metal discharge. The two refractory pipes must be machined quite accurately in the surface regions thereof that are in contact with each other in order to obtain an absolute seal. The machining of these cylindrical rotational surfaces is, therefore, relatively time-consuming. In addition, the risk of breaking the pipes off during assembly and also during operation is relatively high due to possible generation cross forces.

SUMMARY OF THE INVENTION

The object of the present invention is to further develop a slide gate nozzle or shut-off control valve of the aforementioned type in such a manner that its shut-off parts can be manufactured in a simpler manner and thus more cost effectively, and in addition to obtain a higher operational reliability.

This object is achieved in accordance with the invention in that each shut-off part within the vessel has at least one approximately planar sliding surface. The two shut-off parts can be displaced sealingly relative to one another at such planar surfaces in order to open or close passages of openings through the parts. The planar sliding surfaces can be manufactured in a simple manner and guarantee optimal operational reliability.

In an advantageous embodiment of the invention, one shut-off part is mounted stationarily in the vessel and the other, part is displaceable within the vessel. Both shut-off parts can be provided with one or two parallel sliding surfaces.

In a variant, the stationary shut-off part has a recess within which is received a plate to open or close the discharge openings.

The invention also is quite suitable for thin slab casting wherein the passages or openings are designed in the shape of elongated slots.

BRIEF DESCRIPTION OF THE DRAWINGS

Embodiments and other advantages of the invention are explained in detail, with reference to the accompanying drawings, in the following description:

FIG. 1 is an axial sectional view of a slide gate or shut-off nozzle according to the invention;

FIG. 2 is a transverse cross-sectional view of the slide gate nozzle according to FIG. 1, the upper half of FIG. 2 being taken at an axial position through a lateral passage and the bottom half of FIG. 2 being taken at a position below such passage;

FIG. 6 is an axial sectional view of another embodiment of the invention;

FIG. 7 is a view taken along line VII—VII of FIG. 6; and

FIG. 8 is a perspective view, in transverse section an embodiment with slotted passages.

DETAILED DESCRIPTION OF INVENTION

Figure 3:
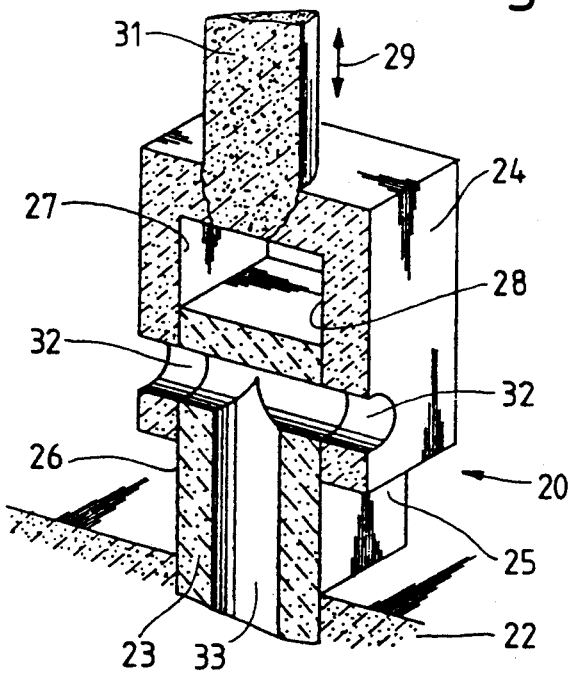
FIG. 3 is a perspective view, in axial section embodiment of the invention.

FIG. 1 shows a slide gate nozzle or shut-off valve 10, arranged in a lining 13 of a vessel 12 to contain molten metal or a distributor for use in a continuous casting installation. Shut-off valve 10 substantially comprises a stationary refractory shut-off part 11 and a moveable refractory shut-off part 15 guided for movement axially or longitudinally in stationary refractory shut-off part 11. The stationary part 11 includes a cylindrical sleeve-shaped portion 14 embedded in the refractory vessel bottom and a plate-shaped extension 16 that projects into the vessel interior and that has a planar sliding surface 17 extending parallel in the direction of displacement of moveable part 15. Surface 17 makes sealing contact with a planar sliding surface 18 formed by a segmented recess in moveable part 15. By displacing shut-off part 15, a transverse passage 19 extending through the plate-shaped extension 16 can be brought more or less into alignment with a passage 19' extending through part 15. Displacement of part 15 vertically can be achieved by a drive (not shown) to thereby makes it possible for the molten metal within the vessel to flow through passage 19 and then through opening 19', for example, into a continuous casing mold. FIG. 2 shows also the planar sliding surfaces 17, 18 of shut-off parts 11, 15.

Slide gate nozzle or shut-off valve 20 of the embodiment of FIG. 3 has a stationary refractory shut-off part 23 that is cemented into a ladle bottom 22, shown only partially. Part 23 is rectangular and has two opposite parallel sliding surfaces 25 and 26. Sliding surfaces 25, 26 make sealing contact with respective sliding surfaces 27 and 28 of a U-shaped moveable refractory shut-off part 24 that can be adjusted in a height or vertical direction 29 and that has in each vertical leg thereof an opening 32. Opening 32 thus can be aligned with a passage 33 extending through stationary shut-off part 24, thereby to open valve 20.

Figure 4:
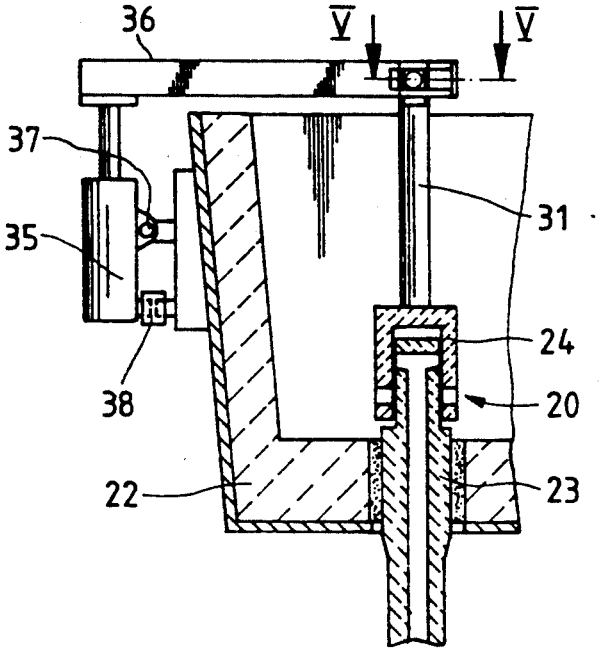
FIG. 4 is an elevational view of the slide gate nozzle of FIG. 3 and a drive unit therefor mounted on a vessel.
Figure 5:
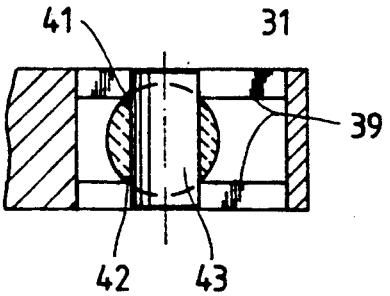
FIG. 5 is a partial section taken along line V-V of FIG. 4.

FIG. 4 shows slide gate nozzle or shut-off valve 20 mounted in ladle 22 with a related drive unit. The vertically adjustable shut-off part 24 can be displaced by means of linkage 36 by a drive 35 in the form of a piston-cylinder unit that is mounted laterally on ladle 22 by a hinge 37 and by setscrews 38 operable to adjust the axis of drive 35 to be parallel relative to that of shut-off part 24. A refractory rod 31 extending from shut-off part 24 is held by a bolt 43 at linkage 36 such that it is fixed vertically relative to the sliding surfaces 27, 28 with adequate play relative to the direction of sliding surfaces 27, 28, as shown in FIG. 5. Thus, it is ensured that shut-off part 24 will not break off, on the one hand, and is positioned with respect to the stationary shut-off part 23, on the other hand. With respect to this positioning, rod 31 has on its upper end two stop faces 41 and 42, which make it possible to center rod 31 in a recess 39 of linkage 36 without any play. Shut-off part 24 could be displaced just as well horizontally or in a swivel movement in order to regulate valve 20.

Slide gate nozzle or shut-off valve 50 shown in FIGS. 6 and 7 includes a refractory shut-off part 53 that is stationary in vessel bottom 52 and that has a passage 55 that extends into the vessel interior laterally and that then extends vertically through an additional sleeve 56 or a casting pipe outwardly of the vessel. The stationary shut-off part 53 has a recess 57 that intersects the lateral portion of passage 55 and in which is mounted a refractory plate 54 that can be displaced sealingly. The molten metal can be poured in a controlled manner through longitudinal and/or swivel movement of plate 54 to align a cross opening 55' thereof with passage 55. Plate 54 also has a refractory extension 58 and can be displaced in a manner similar to the structure shown in FIG. 4. Rod 58 also could be guided laterally or downwardly out of the vessel or ladle.

Slide gate nozzle or shut-off valve 60 shown in FIG. 8 differs from that of FIG. 3 only to the extent that its refractory shut-off parts 63 and 64 are elongated and that respective passages 65 and 66 thereof are elongated and slotted. In particular when casting thin slabs, there is a need when casting a strip to shape the discharge passage or opening 66 from a vessel 62 in the form of a slot. In the opening position the passages or openings 65 of the moveable shut-off par 64 that extend in the horizontal direction align with portions of passage or opening 66 that extend transversely and from there to a vertical portion of passage 66. Through height adjustment 67 of part 64 a precisely metered volume of melt can be discharged from the vessel in the shape of a strip.

Further, the embodiment of FIG. 8 could be arranged with the axial portion of passage 66 extending approximately horizontally out of the ladle. In such an arrangement, the sliding surfaces of both shut-off parts 63 and 64 would enable approximately horizontally within the vessel.

Other variants of the invention also are possible. Thus, it is conceivable that, for example, with the slide gate nozzle of FIG. 3 that upper shut-off part is stationary, whereas the lower shut-off part can be moved longitudinally in the vessel bottom.

I claim:

1. In a metallurgical vessel having attached thereto a slide gate nozzle for controlling the discharge of molten metal from the interior of said vessel, the improvement wherein said nozzle comprises:

a pair of refractory shut-off parts mounted within said interior of said vessel for relative sliding movement therebetween, each said shut-off part having extending therethrough a respective discharge passage;

each said shut-off part having at least one planar sliding surface with each respective discharge passage opening onto the respective said planar sliding surface; and said shut-off parts being positioned with said respective planar sliding surfaces thereof in sealing abutment, so that relative sliding movement between said parts along said planar surfaces will bring said discharge passages into and out of alignment.

2. The improvement claimed in claim 1, wherein a first said shut-off part is stationarily mounted in said vessel, and a second said shut-off part is mounted within said interior with respect to said first shut-off part for sliding movement relative thereto.

3. The improvement claimed in claim 2, wherein said discharge passage through said first shut-off part is open into said vessel interior, and said discharge passage through said second shut-off part is open outwardly of said vessel.

4. The improvement claimed in claim 2, wherein said discharge passage through said second shut-off part is open into said vessel interior, and said discharge passage through said first shut-off part is adapted to open outwardly of said vessel.

5. The improvement claimed in claim 2, wherein said second shut-off part is mounted for rectilinear sliding movement relative to said first shut-off part.

6. The improvement claimed in claim 2, wherein said second shut-off part is mounted for swivelling sliding movement relative to said first shut-off part.

7. The improvement claimed in claim 2, wherein said first shut-off part includes a tubular portion mounted in said vessel and a plate-shaped extension projecting from said tubular portion and located in said vessel interior, said planar sliding surface of said first shut-off part being defined on said plate-shaped extension, and said second shut-off part extends through said tubular portion for rectilinear movement relative thereto, said planar sliding surface of said second shut-off part being defined on an exterior of said second shut-off part.

8. The improvement claimed in claim 2, wherein each said shut-off part has two parallel planar sliding surfaces.

9. The improvement claimed in claim 8, wherein said two planar sliding surfaces of said first shut-off part face outwardly in opposite directions, and said two planar sliding surfaces of said second shut-off part face inwardly toward each other.

10. The improvement claimed in claim 9, wherein said discharge passage through said first shut-off part includes a first passage portion extending between said two planar sliding surfaces thereof and a second passage portion extending from said first passage portion in a direction generally parallel to said two planar sliding surfaces.

11. The improvement claimed in claim 10, wherein said discharge passage through said second shut-off part includes separate passage portions extending in opposite directions from respective said inwardly facing planar sliding surfaces.

12. The improvement claimed in claim 11, wherein said second shut-off part is U-shaped and has two spaced legs having at respective interior faces thereof respective said inwardly facing planar sliding surfaces.

13. The improvement claimed in claim 11, wherein said separate passage portions through said second shut-off part are slot-shaped and are elongated in directions parallel to said inwardly facing planar sliding surfaces.

14. The improvement claimed in claim 10, wherein said first and second passage portions through said first shut-off part are slot-shaped and are elongated in directions parallel to said two planar sliding surfaces to said first shut-off part.

15. The improvement claimed in claim 8, wherein said first shut-off part has formed therein a recess defining the respective said two parallel planar sliding surfaces thereof, the said second shut-off part comprises a plate-shaped member defining the respective said two parallel planar sliding surfaces thereof.

16. The improvement claimed in claim 15, wherein said two planar sliding surfaces of said first shut-off part face inwardly toward each other, and said two planar sliding surfaces of said plate-shaped member face outwardly in opposite directions.

17. The improvement claimed in claim 15, wherein said plate-shaped member is movable rectilinearly in said recess.

18. The improvement claimed in claim 15, wherein said plate-shaped member is movable swivelly in said recess.

19. The improvement claimed in claim 15, wherein said plate-shaped member has extending therefrom a refractory extension projecting to the exterior of said vessel.

20. The improvement claimed in claim 2, wherein said discharge passages are of substantially circular cross section.

21. The improvement of claimed in claim 2, wherein said discharge passages are slot-shaped and are elongated in directions parallel to said planar sliding surfaces.

22. The improvement claimed in claim 2, wherein said planar sliding surfaces extend vertically.

23. The improvement claimed in claim 2, further comprising drive means for selectively moving said second shut-off part relative to said first shut-off part.

24. The improvement claimed in claim 23, wherein said drive means comprises a linear drive unit mounted to the exterior of said vessel, and a linking member operable by said drive unit and supporting said second shut-off part.

25. The improvement claimed in claim 24, wherein said second shut-off part has extending therefrom a refractory rod supported by said linking member for play relative thereto in directions transverse to said planar sliding surfaces and without play relative to said linking member in directions parallel to said planar sliding surfaces.

26. In a metallurgical vessel having attached thereto a refractory shut-off part to be employed in combination with another refractory shut-off part to form a slide gate nozzle for controlling the discharge of molten metal from said vessel and located within the interior of said vessel, the improvement wherein said part comprises:

a discharge passage extending through the material of said part; and at least one planar sliding surface onto which opens said discharge passage.

27. The improvement claimed in claim 26, wherein said part comprises a tubular portion mounted in said vessel and a plate-shaped extension projecting from said tubular portion and located in said vessel interior, said planar sliding surface of said first shut-off part being defined on said plate-shaped extension.

28. The improvement claimed in claim 26, wherein said part is of cylindrical configuration with said planar sliding surface formed in an exterior surface thereof and extending axially thereof.

29. The improvement claimed in claim 26, wherein said part has thereon two parallel planar sliding surfaces.

30. The improvement claimed in claim 21, wherein said two planar sliding surfaces face away from each other.

31. The improvement claimed in claim 29, wherein said two planar sliding surfaces face toward each other.

32. The improvement claimed in claim 29, wherein said discharge passage includes a first passage portion extending between said two planar sliding surfaces and a second passage portion extending from said first passage portion in a direction generally parallel to said two planar sliding surfaces.

33. The improvement claimed in claim 29, wherein said discharge passage includes separate passage portions extending in opposite directions from respective said planar sliding surfaces.

34. The improvement claimed in claim 33, wherein said part is U-shaped and has two spaced legs having respective interior faces defining respective said planar sliding surfaces.

35. The improvement claimed in claim 33, wherein said separate passage portions are slot-shaped and are elongated in directions parallel to said planar sliding surfaces.

36. The improvement claimed in claim 32, wherein said first and second passage portions are slot-shaped and are elongated in directions parallel to said two planar sliding surfaces.

37. The improvement claimed in claim 26, wherein said part has formed therein a recess defining two said parallel planar sliding surfaces.

38. The improvement claimed in claim 26, wherein said part is plate-shaped and defines on opposite sides thereof two said planar sliding surfaces.

39. The improvement claimed in claim 38, wherein said plate-shaped part has extending therefrom a refractory extension projecting to the exterior of said vessel.

40. The improvement claimed in claim 26, wherein said discharge passage is of substantially circular cross section.

41. The improvement claimed in claim 26, wherein said discharge passage is slot-shaped and is elongated in a direction parallel to said planar sliding surface.

42. A slide gate nozzle for controlling the discharge of molten metal from the interior of a metallurgical vessel, said nozzle comprising:

a refractory first shut-off part adapted to be stationarily mounted in the vessel, said first shut-off part including a tubular portion to be mounted in the vessel and a plate-shaped extension projecting from said tubular portion and adapted to be located in the vessel interior, said plate-shaped extension defining a first planar sliding surface, and said first shut-off part having extending therethrough a discharge passage opening onto said first planar sliding surface;

a refractory second shut-off part having defined on an exterior thereof a second planar sliding surface, said second shut-off part having extending therethrough a discharge passage opening onto said second planar sliding surface; and said second shut-off part being mounted to extend through said tubular portion of said first shut-off part for rectilinear sliding movement relative thereto, with said first and second planar sliding surfaces in sealing abutment, so that relative rectilinear sliding movement between said parts along said first and second planar sliding surface will bring said discharge passages into and out of alignment.

43. A slide gate nozzle for controlling the discharge of molten metal from the interior of a metallurgical vessel, said nozzle comprising:

a refractory first shut-off part adapted to be stationarily mounted in the vessel, said first shut-off part having two parallel planar sliding surfaces facing outwardly in opposite directions, and said first shut-off part having extending therethrough a discharge passage including a first passage portion extending between and opening onto said two planar sliding surfaces and a second passage portion extending from said first passage portion in a direction generally parallel to said two planar sliding surfaces;

a refractory second shut-off part having two parallel planar sliding surfaces facing inwardly toward each other, and said second shut-off part having extending therethrough a discharge passage opening onto said two planar sliding surfaces thereof; and said second shut-off part being mounted with respect to said first shut-off part for sliding movement relative thereto, with said two planar sliding surfaces of said second shut-off part in sealing abutment with respective said two planar surfaces of said first shut-off part, so that sliding movement of said second shut-off part relative to said first shut-off part along said planar sliding surfaces will bring said discharge passages into and out of alignment.

44. A nozzle as claimed in claim 43, wherein said discharge passage through said second shut-off part includes separate passage portions extending in opposite directions from respective said inwardly facing planar sliding surfaces.

45. A nozzle as claimed in claim 44, wherein said second shut-off part is U-shaped and has two spaced legs having at respective interior faces thereof respective said inwardly facing planar sliding surfaces.

46. A nozzle as claimed in claim 44, wherein said separate passage portions through said second shut-off part are slot-shaped and are elongated in directions parallel to said inwardly facing planar sliding surfaces.

47. A nozzle as claimed in claim 43, wherein said first and second passage portions through said first shut-off part are slot-shaped and are elongated in directions parallel to said two planar sliding surfaces of said first shut-off part.

48. A slide gate nozzle for controlling the discharge of molten metal from the interior of a metallurgical vessel, said nozzle comprising:

a refractory first shut-off part adapted to be stationarily mounted in the vessel, said first shut-off part having formed therein a recess defining two parallel planar sliding surfaces, and said first shut-off part having extending therethrough a discharge passage opening onto said two planar sliding surfaces;

a refractory second shut-off part in the form of a plate-shaped member having two parallel planar sliding surfaces, said plate-shaped member having extending therethrough a discharge passage opening onto said two planar sliding surfaces thereof; and said plate-shaped member being swivelly mounted within said recess, with said two planar sliding surfaces of said plate-shaped member in sealing abutment with respective said two planar sliding surfaces of said first shut-off part, so that swivelling sliding movement of said plate-shaped member within said recess relative to said first shut-off part along said planar sliding surfaces will bring said discharge passages into and out of alignment.

49. A slide gate nozzle for controlling the discharge of molten metal from the interior of a metallurgical vessel, said nozzle comprising:

a refractory first shut-off part adapted to be stationarily mounted in the vessel, said first shut-off part having formed therein a recess defining two parallel planar sliding surfaces, and said first shut-off part having extending therethrough a discharge passage opening onto said two planar sliding surfaces;

a refractory second shut-off part in the form of a plate-shaped member having two parallel planar sliding surfaces, said plate-shaped member having extending therethrough a discharge passage opening onto said two planar sliding surfaces thereof, said plate-shaped member having extending therefrom a refractory extension adapted to project to the exterior of the vessel; and said plate-shaped member being mounted within said recess, with said two planar sliding surfaces of said plate-shaped member in sealing abutment with respective said two planar sliding surfaces of said first shut-off part, so that sliding movement of said plate-shaped member within said recess relative to said first shut-off part along said planar sliding surfaces will bring said discharge passages into and out of alignment.

50. A refractory shut-off part to be employed in combination with another refractory shut-off part to form a slide gate nozzle for controlling the discharge of molten metal from a metallurgical vessel and to be located within the interior of the vessel, said part comprising:

a tubular portion to be mounted in the vessel and a plate-shaped extension projecting from said tubular portion and adapted to be located in the vessel interior;

said plate-shaped extension defining a planar sliding surface; and the material of said part having extending therethrough a discharge passage opening onto said planar sliding surface.

51. A refractory shut-off part to be employed in combination with another refractory shut-off part to form a slide gate nozzle for controlling the discharge of molten metal from a metallurgical vessel and to be located within the interior of the vessel, said part comprising:

two parallel planar sliding surfaces; and a discharge passage extending through the material of said part, said discharge passage including a first passage portion extending between and opening onto said two planar sliding surfaces and a second passage portion extending from said first passage portion in a direction generally parallel to said two planar sliding surfaces, said first and second passage portions being slot-shaped and elongated in directions parallel to said two planar sliding surfaces.

* * * * *